US005900600A

United States Patent [19]

Alexander et al.

[11] Patent Number: 5,900,600

[45] **Date of Patent: *May 4, 1999**

[54] APPARATUS FOR LOCKING A CIRCUIT BREAKER

[76] Inventors: Richard L. Alexander, 2106 Longhorn St., Houston, Tex. 77080; E. Aaron Alexander, 11515 Easterling, Houston, Tex. 77065

[ * ] Notice: This patent is subject to a terminal disclaimer.

[21] Appl. No.: 08/947,415

[22] Filed: Oct. 8, 1997

Related U.S. Application Data

[63] Continuation-in-part of application No. 08/728,838, Oct. 10, 1996, Pat. No. 5,794,760, and application No. 08/728,837, Oct. 10, 1996, abandoned, each is a continuation-in-part of application No.08/405,590, Mar. 7, 1995, Pat. No. 5,593, 020.

[51] Int. Cl.[6] ..... H01H 9/28

[52] U.S. Cl. ..... 200/43.14; 200/43.11

[58] Field of Search ..... 200/43.14, 43.13, 200/43.15, 43.16, 43.18, 43.19, 43.21

[56] References Cited

U.S. PATENT DOCUMENTS 4,006,324 2/1977 Leasher et al. ..... 200/43.11

5,270,503 12/1993 Frye ..... 200/43.14

*Primary Examiner*—David J. Walczak

*Attorney, Agent, or Firm*—John R. Casperson

[57] ABSTRACT

Apparatus which is well suited for positioning a pin to immobilize a circuit breaker switch comprises an elongated base member and an aperture-defining means, such as a wire or plate, fastened to the base member. The base member is elongated and has a longitudinal axis, an upper face, and a transverse groove extending across the upper face. The defining means is positioned across the transverse groove and in a plane parallel to the longitudinal axis of the base member. A portion of the aperture defined by the aperture-defining means is positioned in alignment with the transverse groove. A pin having longitudinal axis, a preferably generally rectangular or square cross section, and a plurality of longitudinally spaced apart grooves is positioned in the groove of the base member and through a portion of the aperture to immobilize a breaker switch positioned alongside the elongated base member. A lock is also passed through the aperture to block extrication of the pin.

42 Claims, 10 Drawing Sheets

APPARATUS FOR LOCKING A CIRCUIT BREAKER

CROSS REFERENCE TO RELATED APPLICATIONS

This application is a continuation-in-part of application Ser. Nos. 08/728,838, filed Oct. 10, 1996, now U.S. Pat. No. 5,794,760, issued Aug. 18, 1998 and 08/728,837, filed Oct. 10, 1996, now abandoned, which were continuations in part of application Ser. No. 08/405,590, filed Mar. 7, 1995, now U.S. Pat. No. 5,593,020, issued Jan. 14, 1997.

BACKGROUND OF THE INVENTION

1. The Field of the Invention

In one aspect, the present invention pertains to a safety device for use with an electrical circuit breaker 2. The Prior Art There has been a continuing increase in concern for safety in industrial settings, such as all phases of manufacturing, in recent years. This concern has prompted the promulgation of many federal and state laws and regulations which are intended to improve occupational safety. In order to comply with those regulations concerning electrical power, it is now required that there must be a way to positively prevent unintentional restoration of electrical power to machinery which is either not operating or is down for service. The clear purpose of these regulations is to prevent serious injuries or death by the inadvertent supply of electrical power to or the starting of machinery which is assumed to be at least temporarily inactive or disabled. At least one of these regulations specifies that machinery be turned off and the power switch be locked in the off position.

There have been a number of devices proposed to fulfill the above discussed ends. Some of these are in the form of flags or tags which are to be placed on the handle of a circuit breaker which is to be disabled. However, these have the obvious disadvantage of being too easily removed, which could happen through inadvertence and/or oversight, and create an unintended dangerous situation. Another popular solution to this need involves rods and/or bars which pass through or engage apertures in the handles of circuit breakers. These types of solutions have the obvious disadvantage of requiring a certain type of circuit breaker, namely one with an appropriately sized and directed hole in the handle, in order to function. Use of such devices might prove to be extremely expensive in requiring either replacement of circuit breakers with one having appropriate handles or boring holes in the handle of the existing breakers. This latter case would require dismounting of the circuit breaker from the box and circuit in order to safely perform the boring operation. A further approach to the problem is to have a device which is adapted to be mounted adjacent a column of circuit breakers with circuit breaker engaging pins selectively mounted therein to engage and disable the selected circuit breaker.

OBJECTS OF THE INVENTION

It is an object of this invention to provide a safety device which provides positive locking of a wide variety of circuit breakers either in the on or off positions.

It is another object of this invention to provide a safety device which provides universal vertical and horizontal locking alignment with the panel design of any manufacturer.

It is another object of this invention to provide a safety device which can be installed without modification of the breaker box and without the use of tools.

It is a further object of this invention to provide a safety device which accomplishes the foregoing objects economically.

SUMMARY OF THE INVENTION

In one embodiment of the invention, there is provided an apparatus well suited for positioning a pin to immobilize a circuit breaker switch. The apparatus comprises an elongated base member and a plate member fastened to the base member. The base member is elongated and has a longitudinal axis, an upper face, and a transverse groove extending across the upper face. The plate member is positioned across the transverse groove and in a plane parallel to the longitudinal axis of the base member. The plate member defines a transverse aperture. A portion of the aperture is positioned in alignment with the transverse groove.

In another embodiment of the invention, there is provided pin well suited for use with the just described apparatus. The pin has a longitudinal axis, preferably a generally rectangular or square cross section, and a plurality of longitudinally spaced apart grooves extending across at least one face of the body of the pin.

In another embodiment of the invention, the above described apparatus is used in conjunction with the pin for immobilizing a selected breaker switch on a panel face having a column of breaker switches. The elongated base member is positioned alongside the column of breaker switches on the panel face with the transverse groove being in substantial alignment with the breaker switch which has been selected for immobilization. Preferably and adhesive is used to position the elongated base member. The elongated pin is positioned through the aperture and an end of the pin is aligned with the selected breaker switch. The elongated pin is then positioned in the groove and through the portion of the aperture in alignment with the groove. A shackle means is then positioned through a portion of the aperture to immobilize the pin in a position to immobilize the selected breaker switch.

Because the pin provides a mechanism for accommodating misalignments and the design uses the variety of manufacturer spacing designs, one size fits all applications without regard to panel manufacturers designs or dimensions.

The groove in the elongated base member is preferably configured to closely receive the cross section of the pin, to prevent rotation of the pin around its longitudinal axis. The aperture in the plate preferably has a first portion which is positioned above the upper face of the elongated base member and is sized to permit passage of the cross section of the pin and to closely receive an exterior surface of the shackle means and a second aperture portion which is sized to closely receive a portion of one of the longitudinally spaced apart grooves of the pin and prevent movement of the pin along the longitudinal axis of the pin. The aperture is preferably further configured so as to position the exterior surface of the shackle means closely adjacent to the exterior surface of the pin, to prevent removal of the pin from the second aperture portion.

DETAILED DESCRIPTION OF THE PREFERRED EMBODIMENTS

Figure 1:
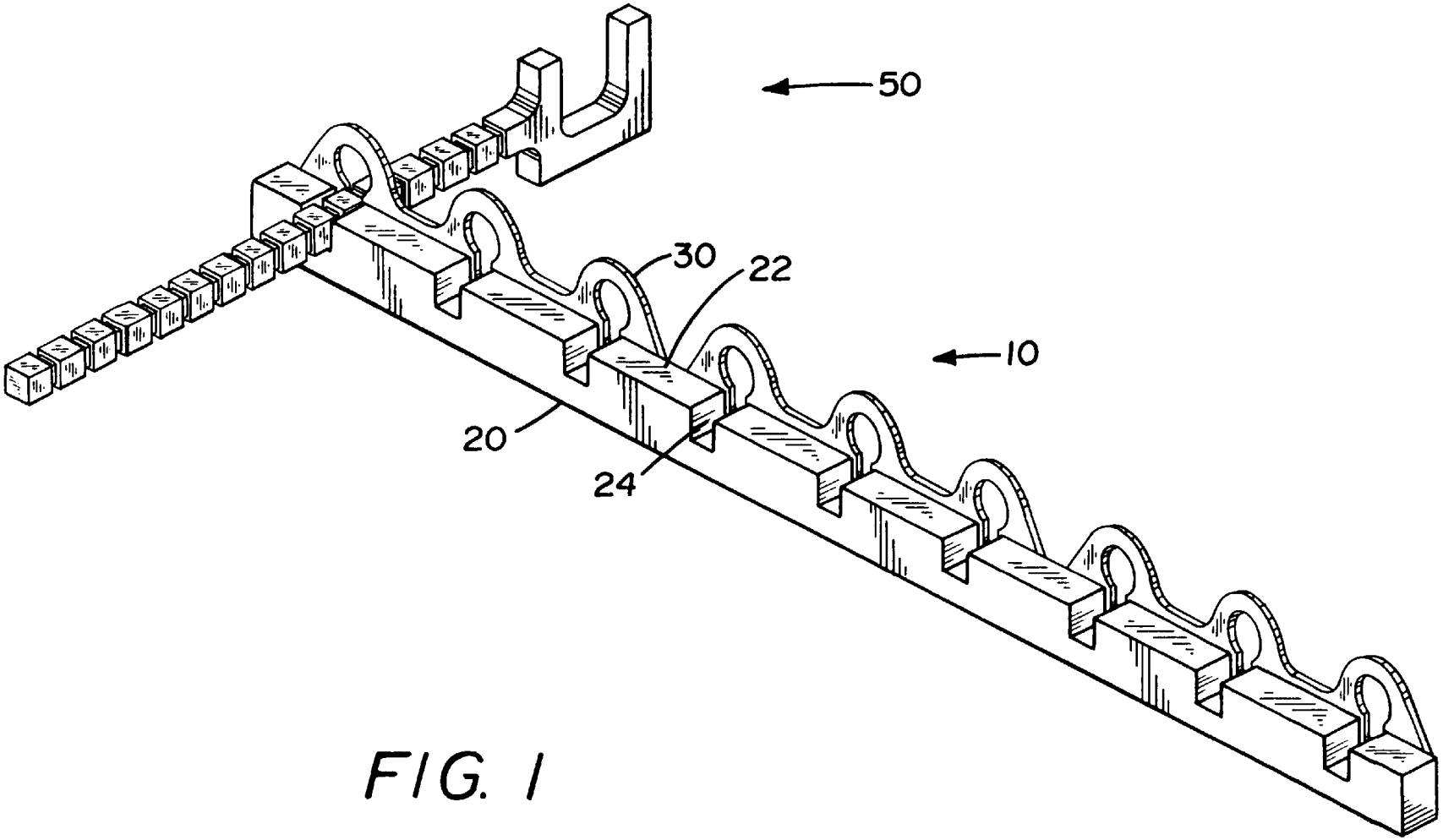
FIG. 1 is an isometric view of an assembled base member, plate and pin.
Figure 2:
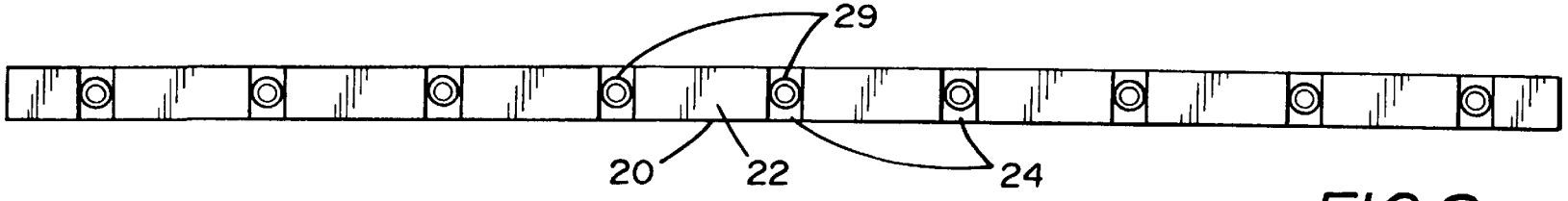
FIG. 2 is a top view of the base member shown in FIG. 1.
Figure 3:
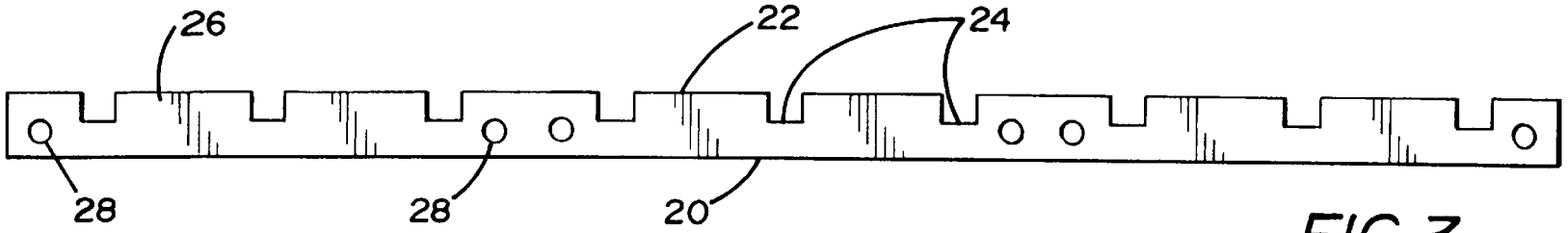
FIG. 3 is a side view of the base member shown in FIG. 1.
Figure 4:
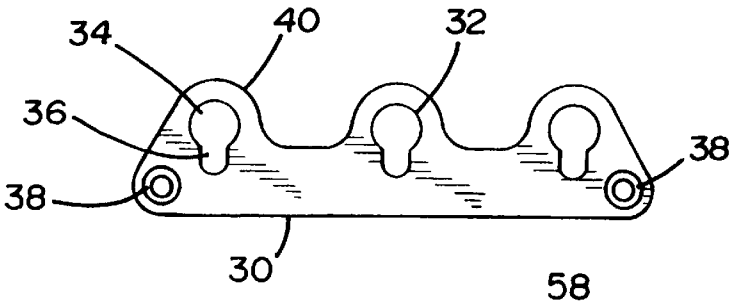
FIG. 4 is a side view of the plate shown in FIG. 1.
Figure 5:
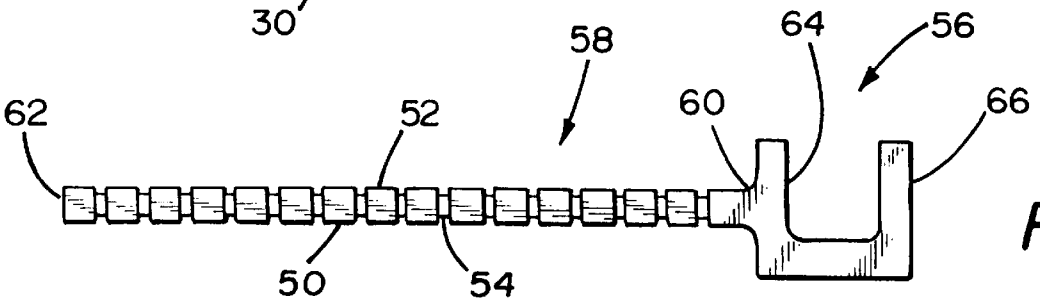
FIG. 5 is a top view of the pin shown in FIG. 1.

In one embodiment of the invention, there is provided an apparatus 10 well suited for positioning a pin 50 to immobilize a circuit breaker switch. The apparatus comprises an elongated base member 20 and a plate member 30 fastened to the base member.

The base member 20 is elongated and has a longitudinal axis, an upper face 22, and a transverse groove 24 extending across the upper face. The elongated base member preferably has a generally planar back surface and a generally planar side surface positioned at a right angle with respect to the back surface. The base member is preferably an elongated solid block which is generally rectangular or square in section and overall appearance and is easily formed from bar stock. The upper face of the base member is preferably intersected by a plurality of parallel spaced transverse grooves defining a plurality of generally uniform preferably rectangular teeth. The base member preferably has a length to match that of a vertical column of circuit breakers and some of the grooves are preferably substantially aligned with the circuit breakers in the column, regardless of the distance between breakers. Preferably, the spacing between the grooves is equal to the spacing between the breaker switches, although selection of a wide locking pin head design and/or locking pin modification in the field can be used to accommodate misalignments. For high voltage applications, a groove spacing of 4 ⅜ inches will provide good results. If desired, one or more base members can be positioned alongside the column, to achieve the desired length and/or configuration. The subject invention can also be utilized with an individual circuit breaker or switch.

The plate member 30 is positioned across the transverse groove 24 and in a plane parallel to the longitudinal axis of the base member 20. The plate member defines a transverse aperture 32. A portion of the aperture is positioned in alignment with the transverse groove 24. The transverse aperture 32 in the plate member is preferably elongated and has a first aperture portion 34 positioned above the upper face of the elongated base member and a second aperture portion 36 positioned in alignment with the transverse groove 24. The first aperture portion is preferably generally circularly shaped and the second aperture portion is preferably generally slot-shaped. The first aperture portion and the second aperture portion together preferably define a generally keyhole-shaped aperture having a major axis and a minor axis. The groove 24 in the base member has a width as measured along the longitudinal axis of the base member. The second aperture portion 36 has a width as measured parallel to the minor axis of the aperture. The width of the second aperture portion is less than the width of the groove.

The plate member is preferably attached to a side surface 26 of the elongated base member 20 via suitable connecting means so that the major axis of the aperture 32 is normal to the upper face 22 of the elongated base member. This can be accomplished using screws which pass through aligned boreholes 38 in the plate member 30 and boreholes 28 in the base member 20. The boreholes are preferably parallel to the upper face 22 of the elongated base member and the boreholes 38 can be countersunk if desired.

In one embodiment of the invention, the plate member 30 has an ear-shaped protrusion 40 defining an upper periphery of the first aperture portion 34. More preferably, the plate member 30 is elongated and has a plurality of transverse apertures 32, the upper periphery each transverse aperture being defined by an ear-shaped protrusion 40 of the plate member 30. The ear shaped protrusions provide a lower profile when the apparatus is in a locked condition.

The pin 50 has a first portion 52 having exterior surface which is closely received by the selected groove 24 and a second portion 54 having an exterior surface which is closely received by the second aperture portion 36 of the plate. Receipt of the first portion of the pin in the groove prevents rotation of the pin around its longitudinal axis and receipt of the second portion of the pin by the second aperture portion of the plate and prevents movement of the pin along its longitudinal axis. Preferably, the pin 50 has a longitudinal axis which is positioned transverse to the base member in a selected groove, a generally rectangular or square cross section, and a plurality of longitudinally spaced apart grooves which extend circumferentially around the pins in the illustrated embodiment. The grooves, one of which is received by the second aperture portion, define the second portion of the pin and the sections of the pin between the circumferentially extending grooves, one of which is received by the groove on the base member, define the first portion of the pin. More preferably the circumferentially extending grooves each has a length as measured longitudinally along the pin which is slightly greater than the thickness of the plate, and generally substantially less than the transverse thickness of the pin. It is preferred that the grooves in the base member have a square cross section and closely receive the pin, and be sufficiently deep so that an upper side surface of the pin will be substantially flush with an upper side surface of the base member.

In a particularly preferred embodiment of the invention, the elongated pin has a head portion 56 on one end for locking a breaker switch and a body portion 58 for receipt by the groove in the base member. The body portion 58 has a first end 60 and a second end 62 and the head portion 56 of the pin is positioned at the first end of the body portion. The head portion 56 of the pin is preferably generally "C" shaped and comprises a pair of parallel legs 64 and 66 positioned transversely to the longitudinal axis of the pin. The body portion 58 of the pin preferably connects to a mid section of one of the parallel legs of the head portion.

Many other suitable single end and double end locking pins with various end profiles or a combination of end profiles could be provided. The locking pins can also be employed without headed ends. As illustrated, one end of the locking pin has been shown provided with a rectangular hook head in the plane of the bar and opening in a direction transverse to the longitudinal axis of the bar. The bar portion of the locking pin is preferably sized for close fitting reception in the grooves of the base member which are of like shape. The locking pin is generally suitable for use with a circuit breaker or switch having a lever reset means. The locking pin shown could be profiled on both ends with like or a combination of profiles. The bar portions preferably are of sufficient length to allow the locking pin to engage a circuit breaker or switch reasonably spaced therefrom and can be trimmed in the field to such length as to prevent interference with adjacent circuit breakers and/or switches.

In use, the elongated base member is mounted on the a panel face 82 having a column 84 of breaker switches 80 positioned thereon. The elongated base member is positioned alongside the column of breaker switches. The subject device can be mounted on or adjacent to a circuit breaker or switch in a number of different ways via suitable connecting means. For example, the base member is shown with a profiled through bore 29 between each of the teeth. Flat head screws could be passed through these bores and driven into the circuit breaker box or the mounting adjacent thereto. Alternatively, the circuit breaker box could be provided with spaced and aligned studs the ends of which are received through bores in the base member and secured thereto by non-reversing push pin clips of known design. The studs would preferably be welded to the circuit breaker box or mounting. It would also be possible to mount the subject invention using any of the well known adhesives which are commercially available.

The present invention would be mounted in approximate alignment with a circuit breaker and alongside the column of breaker switches in any of the above described fashions. The subject circuit breaker safety device would be positioned with the grooves of the base member substantially aligned with the handles, levers or reset buttons of corresponding circuit breakers. In order to lock the position of any circuit breaker or combination of circuit breakers, the lock would be removed from the lock plate and an appropriate locking pin selected for insertion into a groove in substantial alignment with the circuit breaker in point. The selected locking pin would be adjusted for the correct length, if necessary, and inserted into the first aperture portion and over the selected groove in alignment with the circuit breaker to be disabled. The locking pin would be placed with the elongated body in the groove of the base member with the circumferential groove of the locking pin being closely received by the second aperture portion. The head of the locking pin, which is preferably an integral circuit breaker engaging head, would be positioned for engaging a respective handle or lever of the circuit breaker in such fashion as to prevent the movement thereof. A shackle means 90, such as the shackle of a padlock, would then be passed through the first aperture portion of the plate. Preferably, the shackle means 90 has an exterior surface which is preferably closely received by the first aperture portion of the plate and is preferably positioned closely adjacent to the exterior surface of the pin, to substantially immobilize the pin in a position to immobilize the selected breaker switch.

In a typical embodiment the base member would be manufactured in sufficient modular lengths to protect one or a plurality of circuit breakers. Since the design of the subject invention is substantially continuous, it is readily field modified should a short device be needed and only a longer one available on site. In this case the base member would be cut through at a selected groove to the desired length, for example to provide a base member having four to a dozen transverse grooves in parallel spaced relation along the upper face thereof.

The locking pin is shown with a single profiled end. These pins could easily be cut to length, should there not be adequate room for the unneeded portion of the bars. In the alternative, a locking pin could be made double ended by having a bar of fixed length with the same or different profiles on the opposite ends thereof. Such a locking pin would be placed to simultaneously engage a pair of circuit breakers, each spaced from an opposite side of the subject device.

The subject circuit breaker safety device provides for positively locking circuit breakers and/or switches in a manner that conforms to the most severe regulatory commission requirements for strength, visual assurance, simplicity of installation and training, and ease of selection and use, while providing the most dependable safety possible. The present circuit breaker safety device can be used, not only for locking switches in the off position, but also for locking circuits that might be safety, security, or conservation oriented in the on position.

The subject circuit breaker safety device has a low overall profile that allows the door of a circuit breaker box or panel to be closed when locking system is not in use. It is also readily field adaptable for columns of circuit breakers of various lengths. Most importantly, the subject safety device can be used with circuit breakers or switches which have either lever, slide or toggle reset means.

Standard selection and measurement techniques can be used with the present invention for selection of the proper safety device for a high voltage panel or breaker size up to 600 v and 2000 amps. The present invention does not compromise state or national safety codes and regulations and can provide warning notice for each panel to provide assistance in operation. These notices can be used for surveying, identifying, and recording all circuits and their use.

Figure 8:
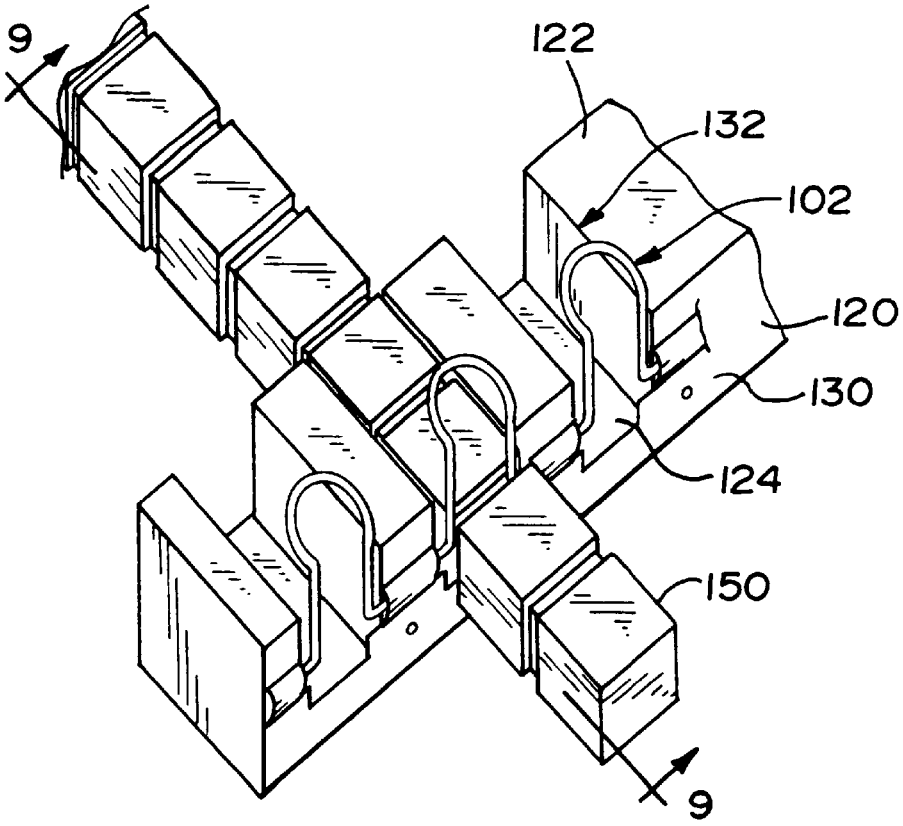
FIG. 8 is a pictorial representation of another embodiment of the invention.
Figure 9:
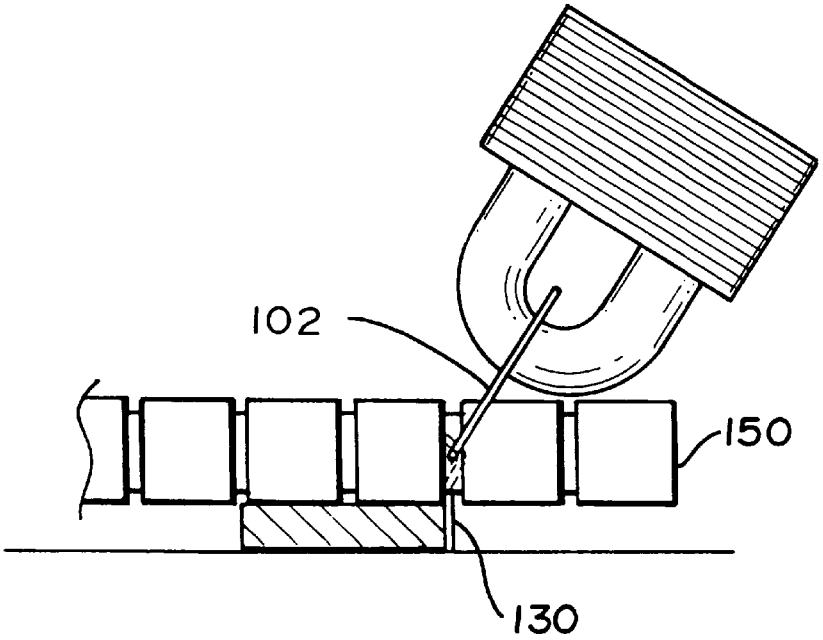
FIG. 9 is a cross sectional view of the device of FIG. 8 when viewed along cut lines 9—9.

FIGS. 8 an 9 illustrate another embodiment of the invention. The embodiment illustrated is well suited for both high voltage and low voltage applications. A wire loop 102 is attached to the side of a base member 120 in alignment with a selected transverse groove 124. When the device is not in use, the wire loop 102 can be folded against the upper face 122 of the base member 120 to permit closure of the panel door. More preferably, the wire loop 102 is formed from spring stock and has a major axis and a minor axis and has a near right angle bend across its major axis so that the loop is biased against the upper face 122 of the base member 120. The wire loop can be generally Ω-shaped or generally inverted U-shaped when viewed in the flattened configuration. The loop partially defines an aperture 132. Preferably, a first portion of the aperture is positioned above the upper face of the elongated base member and a second portion of the aperture is positioned in alignment with the transverse groove 124. The first portion of the aperture is sufficiently large to permit passage of pin 150. The second portion of the aperture is preferably sufficiently small to engage the pin 150 and prevent movement of the pin 150 along its longitudinal axis. Preferably, the pin 150 is provided with a plurality of circumferentially extending grooves each having a length which is slightly greater than the thickness of the wire. A part of the wire forming the second portion of the aperture is preferably closely received by a selected groove to immobilize the pin against movement along its longitudinal axis. If desired, a plate 130 can be used to secure the wire loop alongside the base member. For example, the wire loop can be clamped against the base member by the plate 130, which can be attached to the base member by screws. A portion of the plate can engage with a groove in the pin in a manner analogous to earlier described embodiments of the invention.

In use, the wire loop is lifted off the top surface of the base member and the pin is passed through the first portion of the aperture formed by the loop until the pin is in the desired position with respect to the switch to be immobilized. The pin then positioned in the second portion of the aperture and the groove of the base member and a portion of the wire and/or plate is engaged with a selected groove in the pin to immobilize the pin against movement along its longitudinal axis. A lock shackle which is sized to be closely received by the first portion of the aperture is then passed through the first portion of the aperture to prevent extrication of the pin.

Figure 10:
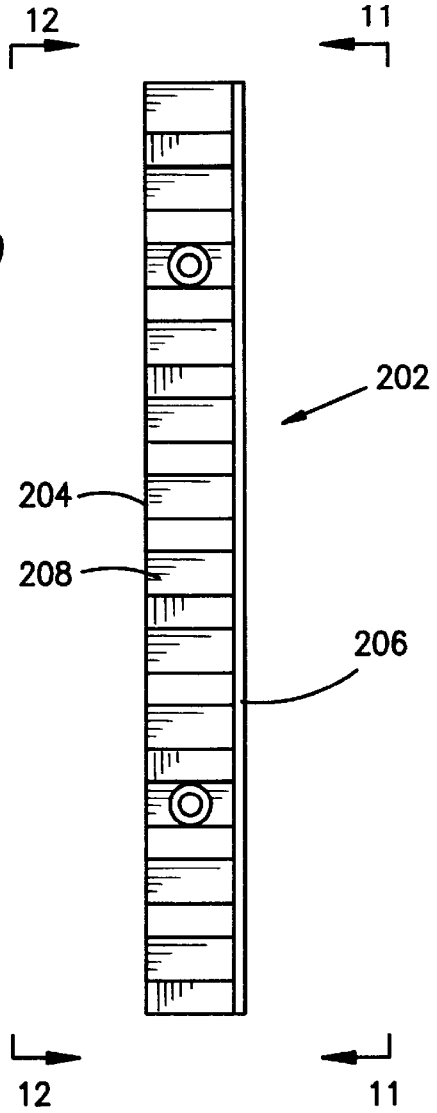
FIG. 10 is a plan view of another embodiment of the invention.
Figure 11:
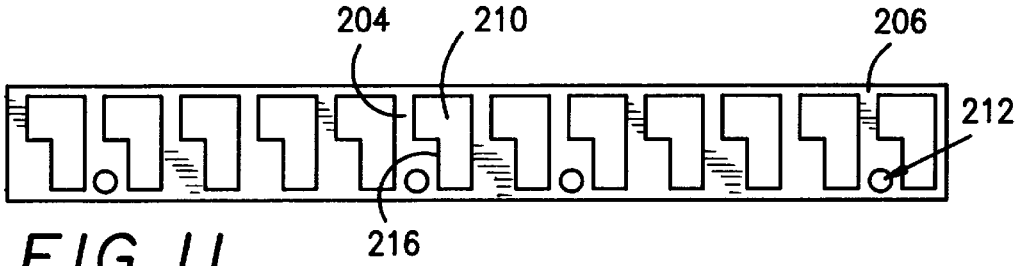
FIG. 11 is a side view of the device shown in FIG. 10 when viewed along lines 11—11.
Figure 12:
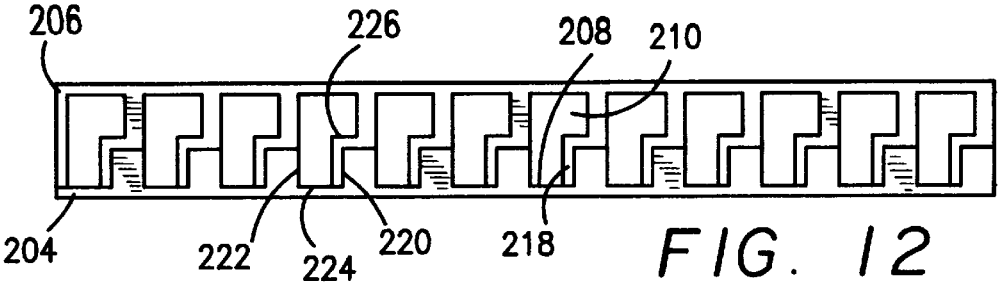
FIG. 12 is a side view of the device shown in FIG. 10 when viewed along lines 12—12.

With reference to FIGS. 10–12, a lock-out device 202 is formed from an elongated base member 204 and a plate member 206. The elongated base member 202 has a longitudinal axis, an upper face, and a transverse groove 208 extending across the upper face. The plate member 206 is positioned in a plane parallel to the longitudinal axis of the base member and has a transverse aperture 210 with a portion of the aperture positioned in alignment with the transverse groove. Means 212 is provided for connecting the elongated base member with the plate member. In the illustrated embodiment, the means 212 is in the form of a rivet. Adhesive materials, such as two part adhesive systems, are also suitable. A two part acrylic system is preferred because it has been tested with good results. 3M brand DP 805 or DP 820 acrylic systems which contain methyl methacrylate and a synthetic polymer, or Lord brand acrylic adhesives 406/#17 and 406/#19 which contain methyl methacrylate and a polymeric resin are given as examples.

The elongated base member preferably has a plurality of parallel transverse grooves, and the plate member is preferably elongated and has a plurality of transverse apertures. Preferably, the elongated base member is formed from bar stock and has a rectangular or square cross section. The grooves are preferably parallel spaced transverse grooves defining a plurality of generally uniform preferably rectangular teeth and preferably extend completely across the front surface of the base member.

Figure 6:
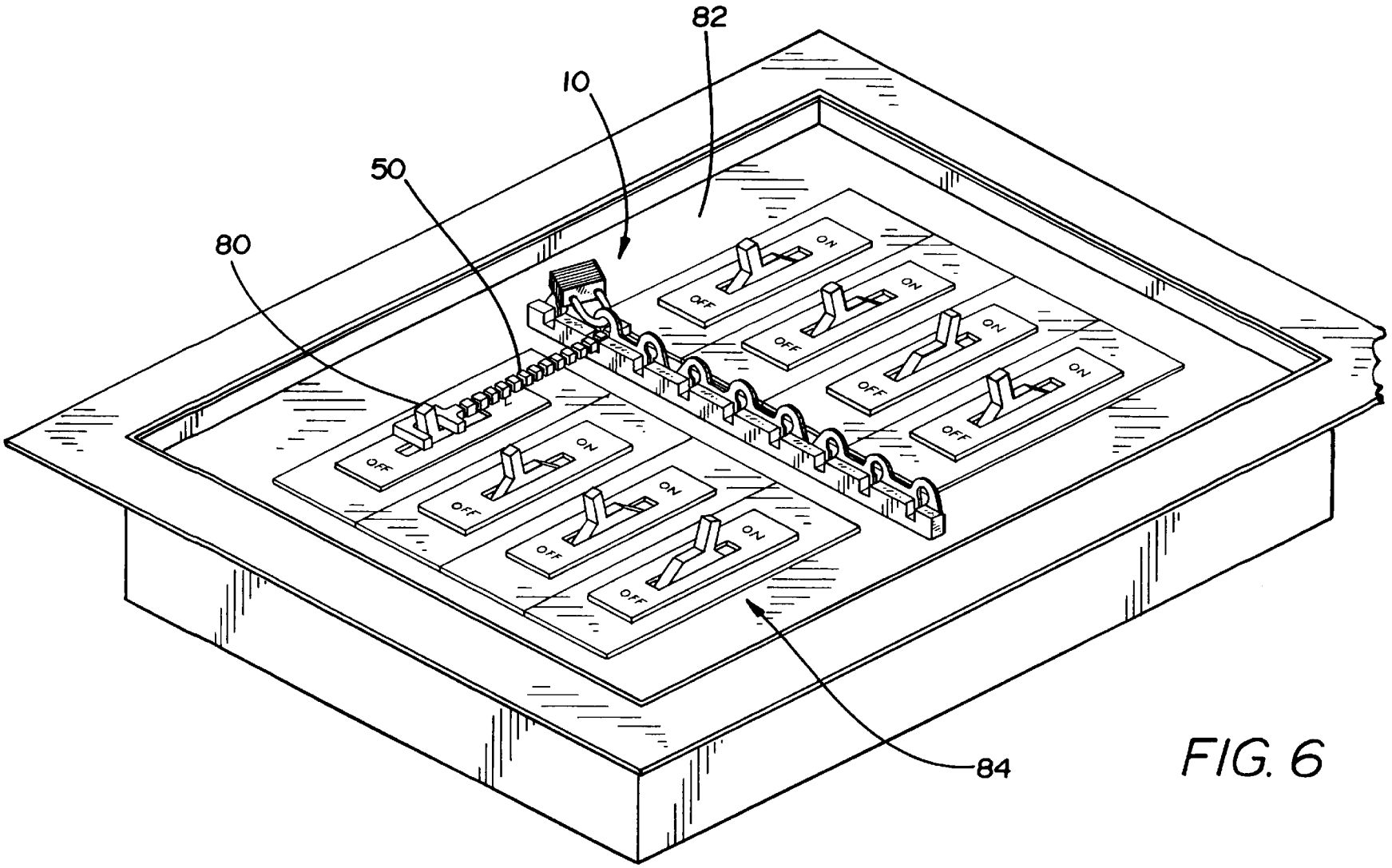
FIG. 6 is an isometric view showing an embodiment of the invention in use to immobilize a breaker switch.
Figure 7:
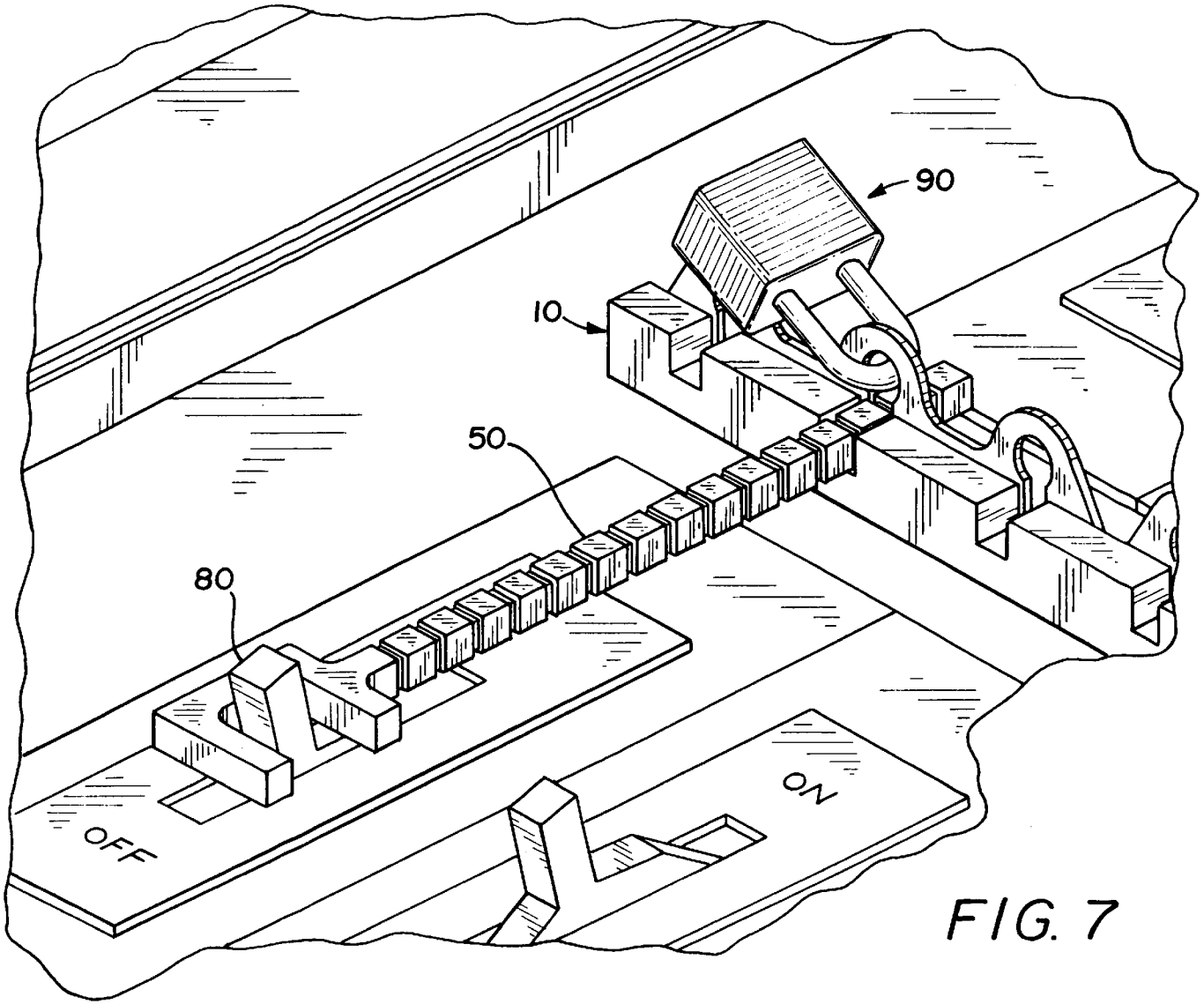
FIG. 7 is a detailed view of a portion of the device shown in FIG. 6.

In the illustrated embodiment, the teeth (or grooves) are positioned on 7/16 inch center to center spacing. The grooves measure ¼ inch in width and the teeth measure 3/16 inches in width. The grooves are ¼ inch deep and the elongated base member is ⅜ inch thick. The width of the base member is generally limited by the space on the panel face between adjacent columns of circuit breakers switches (see FIG. 6). For most applications, a width of ½ inch is suitable, although a greater width will permit larger tolerances in the various components of the device. The length of the base member prior to final fitting is not critical, subject to the limits of the panel face. The subject invention can be utilized with an individual circuit breaker or switch. If desired, one or more base members can be positioned alongside the column, to achieve the desired length and/or configuration. If needed, the base member can be cut in the field to fit the panel face.

The height of the side plate is generally limited by the distance between the panel face and the panel door when in the closed position. The side plate should not be so tall to prevent the panel door on the circuit breaker box from being closed when the lockout device is not in use. A height of ¾ inch or less will generally be suitable.

The transverse aperture 210 in the plate member is elongated and has a first aperture portion 214 positioned above the upper face of the elongated base member and a second aperture portion 216 at least a portion of which is positioned in alignment with the transverse groove 208. The plate member is positioned on the base member so that a portion of the plate member which defines the second aperture portion forms a rib 218 which partially closes an end of the transverse groove. Preferably, the transverse aperture 210 is generally rectilinearly shaped and the rib 218 formed by the plate member is generally straight. More preferably, the transverse aperture is generally keyhole shaped and the first aperture portion 214 is generally square shaped and the second aperture portion 216 is generally rectangularly shaped.

Each transverse groove is defined by a first side face 220, a second side face 222, and a bottom face 224 which extends between the first side face and the second side face. The plate member is positioned on the base member so that the rib is formed at an end of one of the first side face, the second side face, and the bottom face. In the embodiment of the invention shown in FIG. 12, the rib is formed at the end of the first side face. In the embodiment of the invention shown in FIG. 18, the rib is formed at the end of the first side face and the bottom side face.

The generally square shaped first aperture portion 214 has a width as measured parallel to the longitudinal axis of the elongated base member which is greater than the width of the groove as measured between the first face and the second face, and the generally rectangularly shaped second aperture portion 216 has a width as measured parallel to the longitudinal axis of the base member which is preferably less than the width of the groove as measured between the first face and the second face. In the embodiment of the invention shown in FIGS. 10–12, the width of the first aperture portion is about 5/16 inches, and the width of the second aperture portion is about 3/16 inches.

Preferably, the transverse aperture is asymmetrically shaped, and more preferably has a straight side and a side with a shoulder 226. The plate member is positioned on the base member so that no rib is formed at the end of the second side face 222 of the transverse groove.

Figure 13:
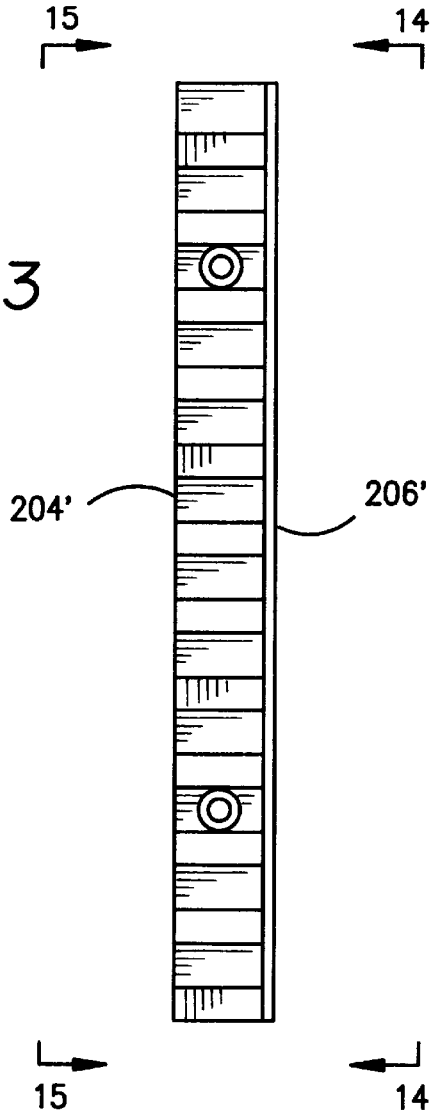
FIG. 13 is a plan view of another embodiment of the invention.
Figure 14:
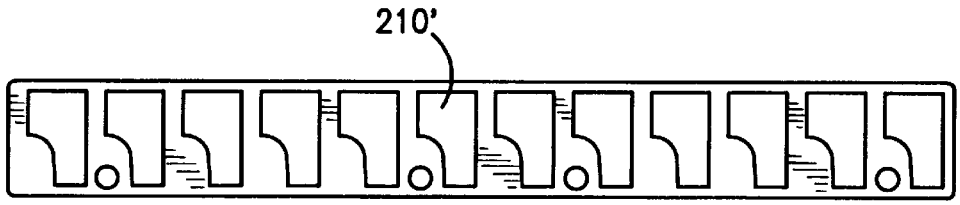
FIG. 14 is a side view of the device shown in FIG. 13 when viewed along lines 14—14.
Figure 15:
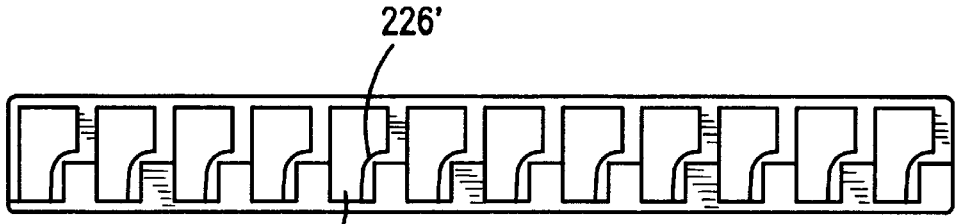
FIG. 15 is a side view of the device shown in FIG. 13 when viewed along lines 15—15.

In FIGS. 13–15, a modified plate 206' is attached to the base member 204. The aperture 210' is provided with a rounded shoulder 226' which is positioned to form a lead-in for the groove 208.

Figure 16:
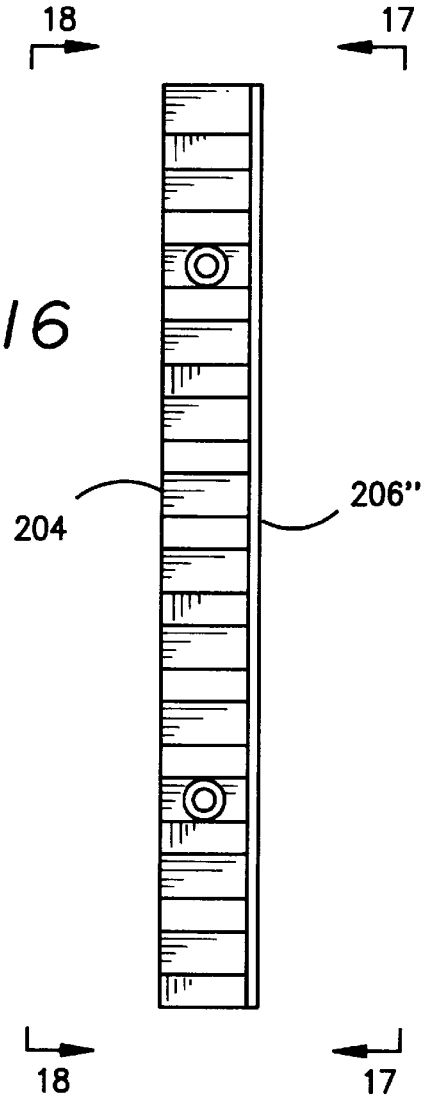
FIG. 16 is a plan view of another embodiment of the invention.
Figure 17:
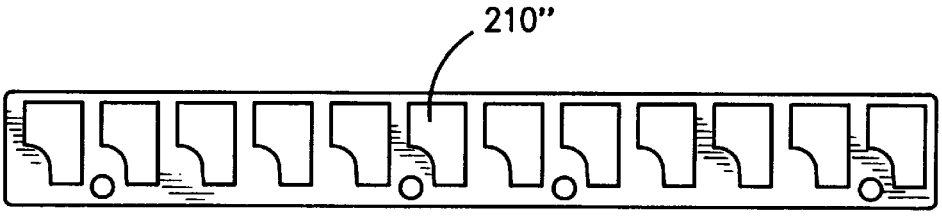
FIG. 17 is a side view of the device shown in FIG. 16 when viewed along lines 17—17.
Figure 18:
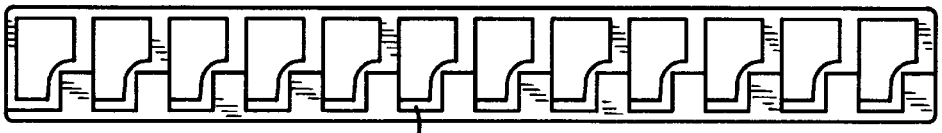
FIG. 18 is a side view of the device shown in FIG. 16 when viewed along lines 17—17.

In FIGS. 16–18, a modified plate 206" is attached to the base member 204. The aperture 210" is dimensioned to further form a lip or rib 219 at the end of the bottom face of the groove. The same result can be achieved by mounting the side plate 206' as shown in FIGS. 13–15 higher on the base member, but the added height may cause problems in mounting the device within a breaker box.

Figure 19:
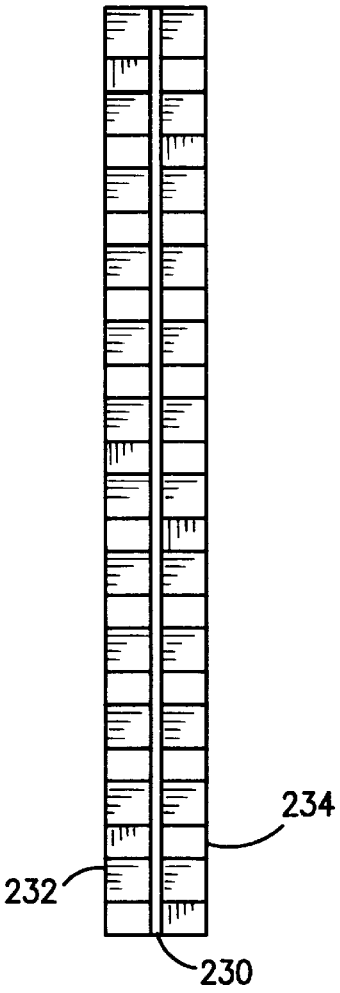
FIG. 19 is a plan view of another embodiment of the invention.

The elongated base member preferably has a generally planar back surface and a generally planar side surface positioned at a right angle with respect to the back surface and the plate member is attached to the side surface. In the embodiment of the invention shown in FIG. 19, the plate member 230 has a first side and a second side, a first elongated base member 232 is attached to the first side of the plate member, and a second elongated base member 234 attached to the second side of the plate member. Second means is provided for attaching the second elongated base member to the second side of the plate member. The adhesive systems previously mentioned are suitable for this purpose.

Figure 23:
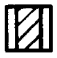
FIG. 23 is a cross sectional view of the device shown in FIG. 21 along lines 23—23.
Figure 24:
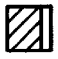
FIG. 24 is a cross sectional view of the device shown in FIG. 22 along lines 24—24.

The apparatus shown in FIGS. 10–15 can be used with the previously described pins, or with modified pins as shown in FIGS. 21–24. The pin 250 shown in FIG. 21 has a rectangular, preferably square cross section, as shown in FIG. 23 and is provided with longitudinally spaced apart grooves 252 extending transversely across opposite faces of the body of the pin. The pin 254 shown in FIG. 22 has a rectangular, preferably square cross section, as shown in FIG. 24 and is provided with longitudinally spaced apart grooves 256 extending transversely across one of the faces of the body of the pin.19. Generally speaking, the pins shown have a longitudinal axis, a generally rectangular cross section, a top side face, a bottom side face, a first side face extending between the top side face and the bottom side face, a second side face extending between the top side face and the bottom side face opposite from the first side face, and a plurality of longitudinally spaced apart grooves formed in the first side face extending between the top side face and the bottom side face. In the embodiment of the invention shown in FIG. 21 the pin further defines a plurality of longitudinally spaced apart grooves formed in the second side face and extending between the top side face and the bottom side face.

The body of the pins is sized so as be closely received by the grooves in the base member so as to prevent rotation of the pins around their longitudinal axis and the groove in the pins is sized so as to closely receive the lip of the second aperture portion of the plate and prevent movement of the pin along its longitudinal axis. To accomplish this, the groove has a length which is slightly greater than the thickness of the plate so that the rib formed by the plate is received by the groove of the pin, and the groove has a depth which is greater than the height of the lip so that the lip can be fully received by the groove. The grooves in the pin have a length as measured along the longitudinal axis of the pin which is small as compared to the width of the pin as measured transverse to the longitudinal axis of the pin. The grooves in the elongated base member preferably have a depth to receive the pin so that the upper surface of the pin is substantially flush with the upper surface of the elongated base member.

Preferably, each pin comprises a head portion 251, 251' for locking a breaker switch and a body portion 253, 253'. The body portion has a first end and a second end and the head portion of the pin is positioned at the first end of the pin. More preferably, the head portion of the pin is generally "C" shaped and the head portion comprises a pair of parallel legs positioned transversely to the longitudinal axis of the pin. The grooves 252, 256 in the pin extend at a right angle to a plane containing the "C" shaped head.

Figure 25:
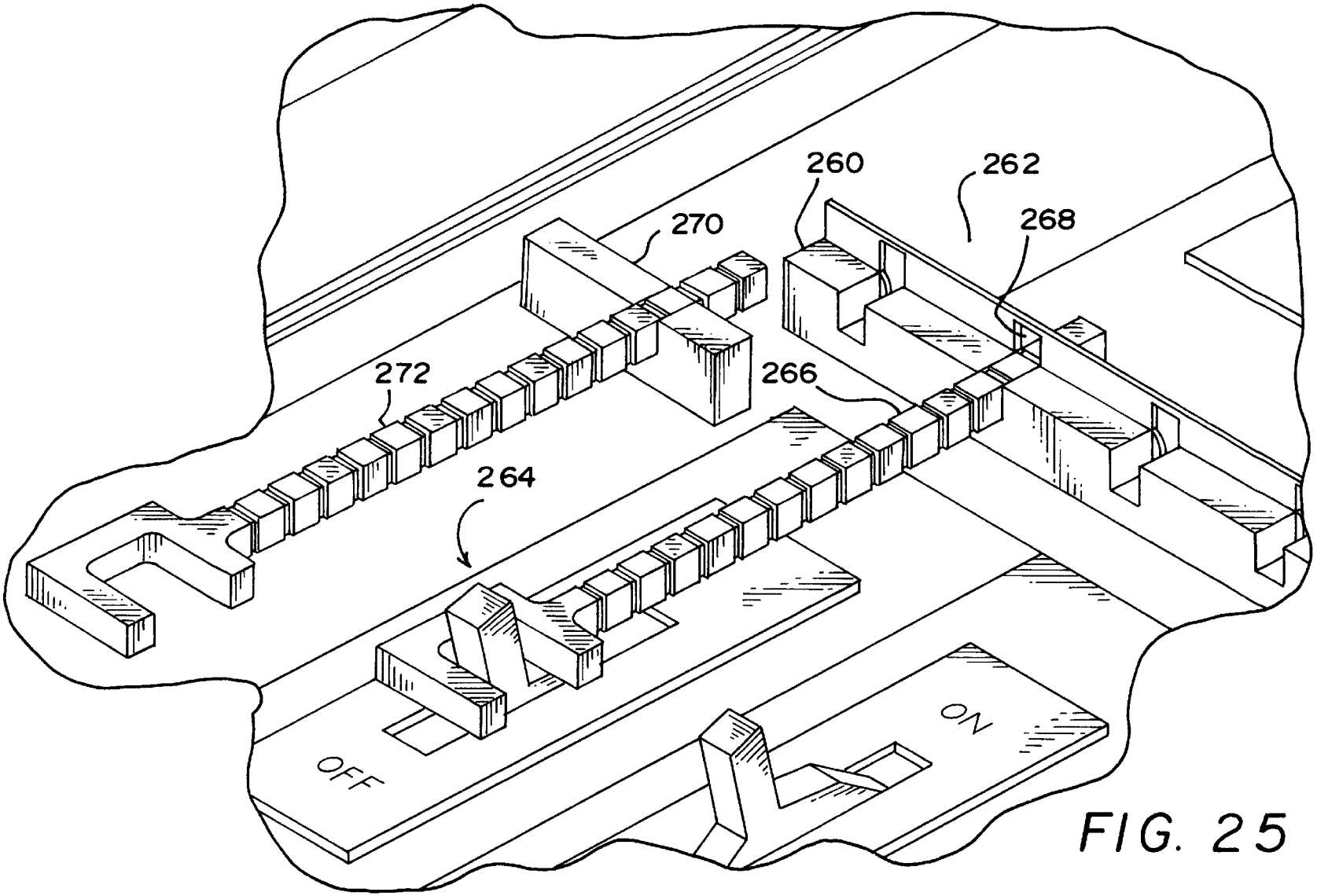
FIG. 25 is a pictorial representation showing certain embodiments of the invention in use together.

With reference to FIG. 25, an elongated base member 260 is mounted on a panel face 262 having a column of breaker switches 264 positioned thereon. The elongated base member is mounted on the panel face alongside the column of breaker switches, preferably adhesively. A pin 266 having a longitudinal axis is positioned transverse to the base member in a selected groove and is positioned to immobilize a breaker switch. An upper portion of the aperture 268 is sized to accept a padlock shackle, to prevent extrication of the pin 29.

Figure 20:
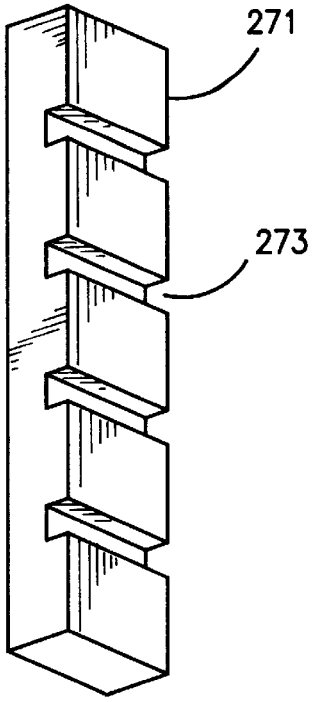
FIG. 20 is a pictorial representation of another embodiment of the invention.
Figure 21:
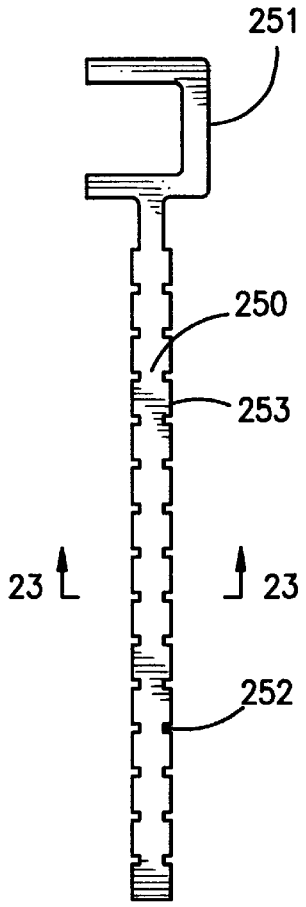
FIG. 21 is a plan view of another embodiment of the invention.
Figure 22:
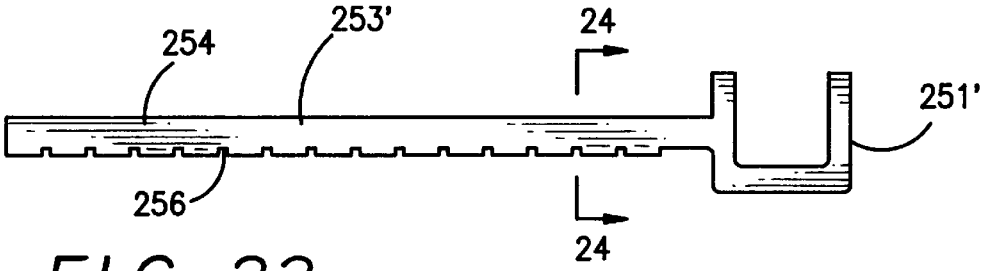
FIG. 22 is a plan view of another embodiment of the invention.

A spare pin holder 270 is also mounted to the panel face, preferably adhesively. The pin holder 270 comprises a second elongated base member having a longitudinal axis, an upper face, and a transverse groove extending across the upper face. The pin holder 260 is preferably formed from a polymeric material and the transverse groove tapers from an upper end to a lower end. A preferred adhesive for mounting the spare pin holder comprises double backed tape, such as Scotch brand VHB 4926 foam tape, which has been used with good results. A preferred polymeric material to form the spare pin holder comprises a rubbery polymer, such as a two part polyurethane, which has been used with good results. It is preferred that the bottom surface of the spare pin holder have a flat face of at least one square inch to provide a surface area which is adequate for reliable mounting with the double backed tape. The groove in the spare pin holder preferably tapers at least 0.005 of an inch to frictionally engage a pin 272 with the polymeric material at the lower end of the groove. For a ¼ inch pin, a tapering of the groove from 0.250 inches at the top to 0.240 inches at the bottom has been used with good results. A preferred pin holder 271 is illustrated in FIG. 20 and has a plurality of grooves 273 for accommodating a plurality of unused pins.

In another aspect of the invention, there is provided a method for mounting an elongated base member having a lower face and an upper face with a plurality of transverse grooves extending across the upper face to a panel face having a column of breaker switches positioned thereon. The method is carried out by applying an adhesive material to at least one of an area of the panel face which has been selected for mounting the elongated base member and the lower face of the elongated base member; and bringing the elongated base member together with the panel face so that the adhesive material is sandwiched between the lower face of the elongated base member and the selected area of the panel face. The adhesives previously described are suitable for carrying out this aspect of the invention.

The present invention may be subject to many modifications and changes without departing from the spirit or essential characteristics thereof. The present embodiments should therefore be considered in all respects as illustrative and not restrictive of the scope of the present invention as defined by the appended claims.

What is claimed is:

1. Apparatus comprising an elongated base member having a longitudinal axis, and an upper face;

a plate member positioned in a plane parallel to the longitudinal axis of the base member and normal to the upper face said plate member having a transverse aperture, and means for connecting the elongated base member with the plate member; wherein the transverse aperture in the plate member is elongated and has a first aperture portion positioned above the upper face of the elongated base member and a second aperture portion positioned between the first aperture portion and the upper face;

and the plate member is positioned on the base member so that a portion of the plate member which defines the second aperture portion forms a rib for engaging a groove in a locking pin.

2. Apparatus as in claim 1 wherein the means for connecting the elongated base member with the plate member comprises an adhesive material.

3. Apparatus as in claim 1 wherein a transverse groove extends across the upper face of the elongated base member;

at least a portion of the second aperture portion is positioned in alignment with the transverse groove with the rib partially closing an end of the transverse groove; and the transverse groove is defined by a first side face, a second side face, and a bottom face which extends between the first side face and the second side face; and the plate member is positioned on the base member so that the rib is formed at an end of one of said first side face, said second side face, and said bottom face.

4. Apparatus in claim 3 wherein the transverse aperture is generally keyhole shaped, the first aperture portion is generally square shaped, and the second aperture portion is generally rectangularly shaped.

5. Apparatus as in claim 4 wherein the generally square shaped first aperture portion has a width as measured parallel to the longitudinal axis of the elongated base member which is greater than the width of the groove as measured between the first face and the second face, the generally rectangularly shaped second aperture portion has a width as measured parallel to the longitudinal axis of the base member which is less than the width of the groove as measured between the first face and the second face, and the transverse aperture is asymmetrically shaped.

6. Apparatus as in claim 5 wherein the transverse aperture has a straight side and a side with a shoulder.

7. Apparatus as in claim 6 wherein the shoulder is rounded.

8. Apparatus as in claim 7 wherein a portion of the plate which forms the rounded shoulder is positioned to form a lead-in for the groove.

9. Apparatus as in claim 3 wherein the elongated base member has a generally planar back surface and a generally planar side surface positioned at a right angle with respect to the back surface and the plate member is attached to the side surface;

wherein the plate member has a first side and a second side, wherein the elongated base member is attached to the first side of the plate member, said apparatus further comprising a second elongated base member attached to the second side of the plate member, and second means for attaching the second elongated base member to the second side of the plate member.

10. Apparatus as in claim 9 wherein the second means for attaching the second elongated base member to the second side of the plate comprises an adhesive material.

11. Apparatus as in claim 3 wherein the elongated base member has a plurality of parallel transverse grooves.

12. Apparatus as in claim 11 wherein the plate member is elongated and has a plurality of transverse apertures.

13. Apparatus as in claim 12 further comprising a pin having a longitudinal axis positioned transverse to the base member in a selected groove.

14. Apparatus as in claim 13 wherein the pin has a first portion positioned in the groove and a second portion positioned in the second aperture portion of the plate.

15. Apparatus as in claim 4 wherein the first portion of the pin has an exterior surface which is closely received by the selected groove and prevents rotation of the pin around its longitudinal axis and the second portion of the pin has an exterior surface which is closely received by the second aperture portion of the plate and prevents movement of the pin along its longitudinal axis.

16. Apparatus as in claim 15 wherein the second portion of the pin has a groove having a length which is slightly greater than the thickness of the plate and the rib formed by the plate is received by the groove of the pin.

17. Apparatus as in claim 16 wherein the pin has a plurality of longitudinally spaced apart grooves and a generally rectangular cross section.

18. Apparatus as in claim 17 wherein the grooves in the base member have a rectangular cross section and closely receive the pin, wherein an upper side surface of the pin is substantially flush with an upper side surface of the base member.

19. Apparatus as in claim 18 further comprising a shackle means positioned through the first aperture portion of the plate, wherein the shackle means is closely received by the first aperture portion of the plate and prevents removal of the pin.

20. Apparatus as in claim 14 wherein the shackle means comprises a padlock.

21. Apparatus as in claim 20 wherein the pin has a first end and a second end and comprises an elongated body portion for receipt by the groove and a head portion for locking a breaker switch, the head portion being positioned at the first end of the pin.

22. Apparatus as in claim 12 further comprising a panel face having a column of breaker switches positioned thereon, wherein the elongated base member is mounted on the panel face alongside the column of breaker switches.

23. Apparatus as in claim 22 wherein the elongated base member is adhesively mounted on the panel face.

24. Apparatus as in claim 22 further comprising a pin having a longitudinal axis positioned transverse to the base member in a selected groove and positioned to immobilize a breaker switch.

25. Apparatus as in claim 22 further comprising an second elongated base member having a longitudinal axis, an upper face, and a transverse groove extending across the upper face mounted on the panel face, wherein the second elongated base member is formed from a polymeric material and the transverse groove tapers from an upper end to a lower end.

26. Apparatus as in claim 25 wherein the second elongated base member is adhesively mounted to the panel face.

27. Apparatus as in claim 25 wherein the polymeric material is a rubbery polymer and the groove tapers at least 0.005 of an inch.

28. Apparatus as in claim 27 further comprising a pin positioned in the groove in the second elongated base member, said pin being frictionally engaged with the polymeric material at the lower end of the groove.

29. Apparatus as in claim 3 wherein the rib is formed at the end of the first side face.

30. Apparatus as in claim 29 wherein the groove in the base member has a width as measured between the first side face and the second side face and the second aperture portion has a width as measured parallel to width to the groove which is less than the width of the groove, and the plate member is positioned on the base member so that no rib is formed at the end of the second side face of the transverse groove.

31. Apparatus as in claim 1 wherein the transverse aperture is generally rectilinearly shaped and the rib formed by the plate member is generally straight.

32. Apparatus as in claim 1 wherein the elongated base member has a generally planar back surface and a generally planar side surface positioned at a right angle with respect to the back surface and the plate member is attached to the side surface.

33. An elongated pin for immobilizing a breaker switch, said pin having a longitudinal axis, a generally rectangular cross section, a top side face, a bottom side face, a first side face extending between the top side face and the bottom side face, and a second side face extending between the top side face and the bottom side face opposite from the first side face, and a plurality of longitudinally spaced apart grooves formed in the first side face extending between the top side face and the bottom side face;

wherein the grooves have a length as measured along the longitudinal axis of the pin which is small as compared to the width of the pin as measured transverse to the longitudinal axis of the pin which is small as compared to the width of the pin as measured transverse to the longitudinal axis of the pin, wherein the pin comprises a head portion for locking a breaker switch and a body portion, wherein the body portion has a first end and a second end and the head portion of the pin is positioned at the first end of the pin; and wherein the head portion of the pin has a wide design to accommodate misalignments between the longitudinal axis of the pin and the breaker switch to be immobilized and is configured to engage a handle or lever of the breaker switch in such fashion as to prevent the movement thereof.

34. An elongated pin for immobilizing a breaker switch, said pin having a longitudinal axis, a generally rectangular cross section, a top side face, a bottom side face, a first side face extending between the top side face and the bottom side face, and a second side face extending between the top side face and the bottom side face opposite from the first side face, and a plurality of longitudinally spaced apart grooves formed in the first side face extending between the top side face and the bottom side face;

wherein the grooves have a length as measured along the longitudinal axis of the pin which is small as compared to the width of the pin as measured transverse to the longitudinal axis of the pin;

wherein the pin comprises a head portion for locking a breaker switch and a body portion, wherein the body portion has a first end and a second end and the head portion of the pin is positioned at the first end of the pin; and wherein the head portion of the pin is generally "C" shaped and the head portion comprises a pair of parallel legs positioned transversely to the longitudinal axis of the pin, wherein the grooves in the pin extend at a right angle to a plane containing the "C" shaped head.

35. An elongated pin as in claim 34 wherein the pin further defines a plurality of longitudinally spaced apart grooves formed in the second side face and extending between the top side face and the bottom side face.

36. A plate for positioning a pin to lock a circuit breaker switch, said plate having a length, a width, and a height and defining a plurality of longitudinally spaced apart transverse apertures extending through the width of the plate, each aperture having an upper portion and a lower portion and having a minor axis parallel to the length of the plate and a major axis parallel to the height of the plate, wherein the lower portion of the aperture is sized to closely receive a pin for locking the circuit breaker switch and the upper portion of the aperture is sized to closely receive a lock to prevent removal of the pin from the lower portion, wherein each aperture is generally keyhole shaped.

37. A plate as in claim 36 wherein the upper aperture portion is generally circularly shaped and the lower aperture portion is generally rectangularly shaped.

38. A plate as in claim 36 wherein the apertures are longitudinally spaced apart at a spacing of about 7/16 inches.

39. A method for immobilizing a circuit breaker switch, said method comprising positioning a plate alongside a column of circuit breaker switches, said plate having a plurality of apertures extending therethrough, each aperture having an upper portion and a lower portion and being generally keyhole shaped, one of said apertures being in general alignment with a circuit breaker switch to be immobilized;

selecting a pin having a length suitable for immobilizing the selected circuit breaker switch when said pin is engaged with the plate;

inserting the selected pin through the upper portion of the aperture which is in general alignment with the breaker switch to be immobilized until a head end of the pin is positioned to prevent movement of the circuit breaker switch to be immobilized; then positioning the pin in the lower portion of the aperture to engage a groove in the pin with the plate, and thereafter passing a shackle means through the upper portion of the aperture to substantially immobilize the pin in a position to substantially immobilize the selected circuit breaker switch.

40. A method as in claim 39 wherein the head end of the pin has a wide design to accommodate misalignments between the aperture through which the pin is inserted and the selected circuit breaker switch.

41. A plate as in claim 36 wherein the upper portion of the aperture is generally square shaped, and the lower portion of the aperture is generally rectangularly shaped.

42. A plate as in claim 36 further comprising, in combination a panel carrying a column of circuit breaker switches, wherein said plate is positioned on the panel alongside the column of circuit breaker switches so that one of said apertures is in general alignment with a circuit breaker switch to be immobilized; and an elongated pin having a longitudinal axis, a generally rectangular cross section, a top side face, a bottom side face, a first side face extending between the top side face and the bottom side face, and a second side face extending between the top side face and the bottom side face opposite from the first side face, and a plurality of longitudinally spaced apart grooves formed in the first side face extending between the top side face and the bottom side face, said elongated pin being positioned through the lower portion of the aperture which is in general alignment with the circuit breaker switch to be immobilized with one of the longitudinally spaced apart grooves engaging the plate so as to prevent movement of the elongated pin along its longitudinal axis;

wherein the elongated pin comprises a head portion for locking a circuit breaker switch and a body portion, wherein the body portion has a first end and a second end and the head portion of the pin is positioned at the first end of the pin;

wherein the head portion of the pin has a wide design to accommodate misalignments between the longitudinal axis of the pin and the breaker switch to be immobilized, and the head portion of the pin is positioned to prevent movement of the circuit breaker switch to be immobilized.

* * * * *

UNITED STATES PATENT AND TRADEMARK OFFICE

CERTIFICATE OF CORRECTION

PATENT NO. : 5,900,600
DATED : May 4, 1999
INVENTOR(S) : Richard L. Alexander and E. Aaron Alexander It is certified that error appears in the above-identified patent and that said Letters Patent is hereby corrected as shown below:

Column 13,
Line 28, after "pin" please insert -- . --.
Line 28, after "." and continuing through lines 29 and 30, please delete "which is small as compared to the width of the pin as measured transverse to the longitudinal axis of the pin."

Signed and Sealed this

Twenty-fifth Day of January, 2005

JON W. DUDAS
*Director of the United States Patent and Trademark Office*